US008375672B2

(12) United States Patent
Hannig

(10) Patent No.: US 8,375,672 B2
(45) Date of Patent: Feb. 19, 2013

(54) FLOOR PANEL PROVIDED WITH A CORE MADE OF A DERIVED TIMBER PRODUCT, A DECORATIVE LAYER AND LOCKING SECTIONS

(75) Inventor: Hans-Juergen Hannig, Bergisch Gladbach (DE)

(73) Assignee: Akzenta Paneele + Profile GmbH, Kaisersesch (DE)

( * ) Notice: Subject to any disclaimer, the term of this patent is extended or adjusted under 35 U.S.C. 154(b) by 199 days.

(21) Appl. No.: 11/917,630

(22) PCT Filed: Jun. 14, 2006

(86) PCT No.: PCT/DE2006/001030

§ 371 (c)(1),
(2), (4) Date: Jan. 9, 2008

(87) PCT Pub. No.: WO2006/133690

PCT Pub. Date: Dec. 21, 2006

(65) Prior Publication Data

US 2009/0049787 A1 Feb. 26, 2009

(30) Foreign Application Priority Data

Jun. 16, 2005 (DE) ..... 10 2005 028 072

(51) Int. Cl.
*E04B 2/00* (2006.01)
*E04B 2/08* (2006.01)

(52) U.S. Cl. ..... 52/588.1; 52/589.1; 52/591.1

(58) Field of Classification Search ..... 52/592.1, 52/588.1, 591.4, 536, 592.5, 589.1, 591.1; 403/364, 339, 340

See application file for complete search history.

(56) References Cited

U.S. PATENT DOCUMENTS

| | | | | |
|---|---|---|---|---|
| 2,328,051 | A * | 8/1943 | Bull | 52/489.2 |
| 3,628,297 | A * | 12/1971 | Richardson | 52/267 |
| 6,345,481 | B1 * | 2/2002 | Nelson | 52/592.2 |
| 6,418,683 | B1 * | 7/2002 | Martensson et al. | 52/282.1 |
| 6,505,452 | B1 * | 1/2003 | Hannig et al. | 52/582.1 |

(Continued)

FOREIGN PATENT DOCUMENTS

| | | | |
|---|---|---|---|
| DE | 200 02 744 | | 8/2000 |
| DE | 19963203 | A1 * | 9/2001 |

(Continued)

OTHER PUBLICATIONS

Translation performed by USPTO STIC Translations Branch Language Services, DE 200 02 744 (U1), Published in German Aug. 3, 2000, made available through Derwent World Patents Index (DWPI).*

*Primary Examiner* — Brian Glessner
*Assistant Examiner* — Joseph J Sadlon
(74) *Attorney, Agent, or Firm* — Lucas & Mercanti, LLP

(57) ABSTRACT

The rectangular floor panel comprises a core of timber material, a decorative layer on the top and pairs of opposite side edges with complementary form-fitting hooked profiles. A receiving hook facing the lower side of the floor panel and a retaining hook located on the opposite side edge and facing the top side of the floor panel. The receiving and retaining hooks are provided with a distal side surface, one having at least one projecting interlocking element and another having an associated receiving pocket. The retaining hook is lockable with the receiving hook by vertical movement. The interlocking element and the top side of the floor panel are separated by at least one gap corresponding to one third the total thickness of the floor panel.

5 Claims, 3 Drawing Sheets

U.S. PATENT DOCUMENTS

Figure 1:
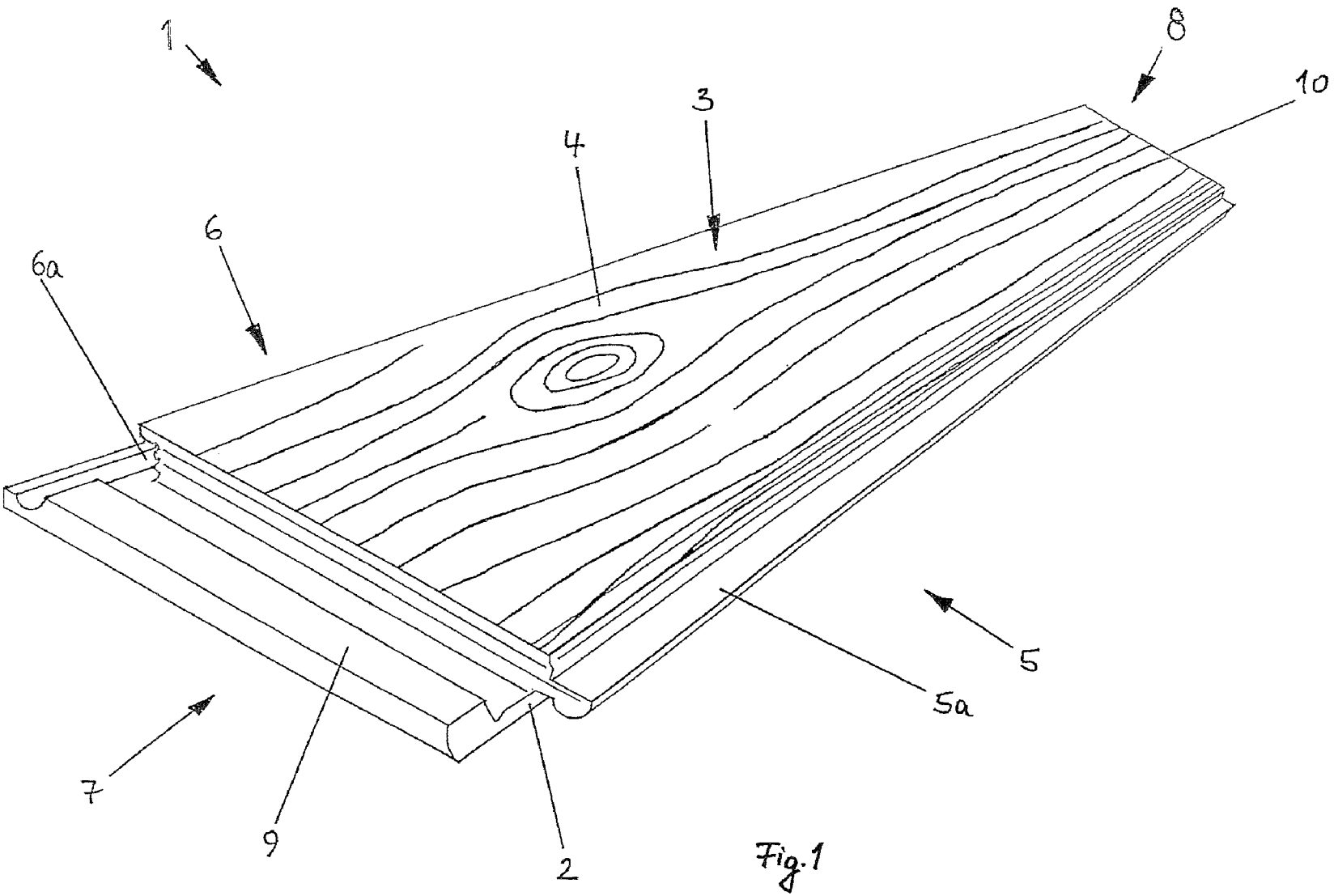

| | | | | |
|---|---|---|---|---|
| 6,536,178 | B1 * | 3/2003 | Palsson et al. | 52/589.1 |
| 6,546,691 | B2 * | 4/2003 | Leopolder | 52/747.1 |
| 6,851,237 | B2 * | 2/2005 | Niese et al. | 52/480 |
| 6,854,235 | B2 * | 2/2005 | Martensson | 52/601 |
| 6,862,857 | B2 * | 3/2005 | Tychsen | 52/582.1 |
| 6,880,307 | B2 * | 4/2005 | Schwitte et al. | 52/592.1 |
| 7,040,068 | B2 * | 5/2006 | Moriau et al. | 52/591.3 |
| 7,543,417 | B2 * | 6/2009 | McIntosh et al. | 52/589.1 |
| 7,621,094 | B2 * | 11/2009 | Moriau et al. | 52/588.1 |
| 7,908,816 | B2 * | 3/2011 | Grafenauer et al. | 52/586.2 |
| 2004/0031225 | A1 * | 2/2004 | Fowler | 52/578 |
| 2004/0182036 | A1 * | 9/2004 | Sjoberg et al. | 52/592.1 |
| 2005/0166516 | A1 * | 8/2005 | Pervan | 52/589.1 |

FOREIGN PATENT DOCUMENTS

| | | | |
|---|---|---|---|
| DE | 201 20 704 | A | 4/2002 |
| DE | 202 03 311 | | 5/2002 |
| DE | 10120062 | | 11/2002 |
| DE | 29924454 | | 5/2003 |
| EP | 1 350 904 | | 10/2003 |
| EP | 1 512 808 | | 3/2005 |
| WO | 01/02670 | A | 1/2001 |
| WO | 01/75247 | A | 10/2001 |

* cited by examiner

FLOOR PANEL PROVIDED WITH A CORE MADE OF A DERIVED TIMBER PRODUCT, A DECORATIVE LAYER AND LOCKING SECTIONS

The invention relates to a rectangular floor panel, comprising a core made of a derived timber material and a decorative layer on the top side of the floor panel, with pairs of opposite side edges, where one pair of side edges displays complementary, form-fitting hooked profiles, namely a receiving hook facing the lower side of the floor panel and, on the opposite side edge, a retaining hook facing the top side of the floor panel, where both the receiving hook and the retaining hook display a distal side surface having at least one projecting interlocking element, which is associated with a receiving pocket in the complementary receiving hook, and the retaining hook is lockable with the receiving hook by a locking movement perpendicular to the plane of the floor panel.

Floor panels of this kind display the aforementioned hooked profiles on at least two opposite side edges. The remaining two side edges can display complementary profiles based on a groove and a tongue. These profiles can be connected to each other by contacting the side edge of a new floor panel obliquely with a side edge of a previously laid floor panel and subsequently swinging the new floor panel downwards into the plane of the previously laid floor panel. The latter profiles can be of form-fitting design. Profiles of this category are sufficiently known. They serve to connect floor panels in a first panel row to floor panels in a subsequent panel row.

In contrast, the hooked profiles mentioned in the opening paragraph serve to connect floor panels to each other that are located in the same row.

Both locking of a new floor panel on a previous row and interlocking with a floor panel of the same panel row are brought about by the swinging movement.

Interlocking is accomplished in that the retaining hook is swung down into the receiving hook. In this context, the retaining hook moves within a plane of rotation oriented perpendicularly to the top side of the floor panel. In this way, locking of the floor panel on the previous row takes place simultaneously with interlocking with a floor panel in the same panel row. The interlocking elements display an undercut that counteracts separation of connected hooked profiles.

An embodiment of a floor panel that can be categorised in the same class is known from WO 01/02670 A1. This is the embodiment whose form-fitting hooked profiles are shown in FIG. 5.1 of WO 01/02670 A1. The detail representation shows the complementary hooked profiles in connected state. Both hooked profiles display interlocking elements with a projecting curvature on distal side surfaces. The interlocking elements each engage receiving pockets in the hooked profile of the adjacent floor panel.

It has become apparent that the decorative layer on the top side of the floor panel is damaged during and after locking of the hooked elements. The decorative layer peels off and the top side of the floor panel warps, meaning that the decorative layer on the top side turns up at the side edges.

The object of the invention is to create a floor panel with hooked profiles of a kind that prevent damaging of the decorative layer.

According to the invention, the object is solved in that the interlocking element of the retaining hook and the top side of the floor panel are separated by a distance that, referred to the total thickness of the floor panel, corresponds to at least one-third of the total thickness of the floor panel.

The invention exploits a special property of the core made of a derived timber material. This special property consists in a decreasing density of the derived timber material with increasing material depth. A board made of a derived timber material consists of wood particles that have been mixed with binders and compacted in a press. The density of this kind of board made of a derived timber material is high near a surface, such as the top side or the lower side of the board. The density decreases as the distance from the surface increases. Both from the top side and from the lower side of the floor panel, the density initially decreases as the depth of the material increases. The density reaches a minimum in a central plane of the board made of a derived timber material.

It was found with the known floor panel that an interlocking element on a distal side surface of a hooked element causes damage on the decorative layer if it is located close to the top side of the floor panel. The core made of a derived timber material displays a high density close to the top side. If pressure is exerted by an interlocking element in this area, compression occurs in the material that splits the material. Internal cracks grow. Layers of the derived timber material peel off.

The invention envisages location of the interlocking element of the retaining hook at a greater material depth, i.e. at a greater distance from the top side of the floor panel.

The interlocking element is a greater distance from the top side of the floor panel and now lies in a soft area of the derived timber material, displaying a relatively low density in comparison with the density close to the surface. No splitting of the material close to the decorative layer occurs, since the softer material yields more. Moreover, the increased distance of the interlocking element from the top side of the floor panel has the effect that pressure and compression cannot reach up to the decorative layer.

The interlocking element preferably extends over the entire length of the side edge. Alternatively, several interlocking elements can be provided in series, one behind the other.

The distal side surface of the retaining hook preferably displays two interlocking elements. The two interlocking elements enlarge the degree of undercut and increase the retention force that counteracts separation of the hooked profiles.

Handling can be improved in that a first interlocking element of the retaining hook, located closer to the top side of the floor panel, projects farther from the distal side surface of the retaining hook than the second interlocking element. The effect of this is that the interlocking element projecting the shorter distance can pass the interlocking position for the interlocking element projecting the longer distance without inducing interlocking. Both interlocking elements subsequently interlock almost simultaneously in the receiving hook.

A further improvement is obtained if the side edges of the hooked profiles display plane contact surfaces facing towards the top side of the floor panel and such contact surfaces rest against each other in connected state of two floor panels. The contact surfaces are in contact in connected state of two floor panels. Seen from the top side of the floor panels, this results in a closed joint. A closed joint is desirable. This can be favoured by the form of the hooked profiles, e.g. in that the hooked profile is provided with an inclined plane and, as a result of interlocking, undergoes elastic deformation that forces the contact surfaces of two floor panels against each other.

It is useful if, during a locking movement, at least the second interlocking element can be moved past the contact surface of the receiving hook without making contact. The first interlocking element preferably does not project farther from the distal side surface than its contact surface. It is tolerable for the first interlocking element to make slight, grinding contact when passing the contact surface, in which context the grinding contact does not impair the function of the interlocking element.

The receiving hook favourably displays at least one interlocking hump, and the interlocking hump is located in front of the receiving pocket in the locking direction. The interlocking hump projects farther from the side edge than the contact surface of the receiving hook. As a result of elastic deformation of both the interlocking element and the interlocking hump, they engage each other in an undercut. Since the interlocking hump projects farther from the side edge of the receiving hook than its contact surface, the interlocking element of the retaining hook can be moved past the contact surface of the receiving hook without obstruction, until it strikes the interlocking hump and overcomes it by means of mutual elastic deformation.

Preferably, two interlocking humps and two receiving pockets are provided. These interact with two interlocking elements of the retaining hook and increase the retention force of the hooked profiles in interlocked state.

To facilitate interlocking of the two interlocking elements of the retaining hook with the two interlocking humps of the receiving hook, the first interlocking hump is a shorter distance from the top side of the floor panel than the second interlocking hump and projects a shorter distance from the distal side surface of the receiving hook than the second interlocking hump.

Figure 2:
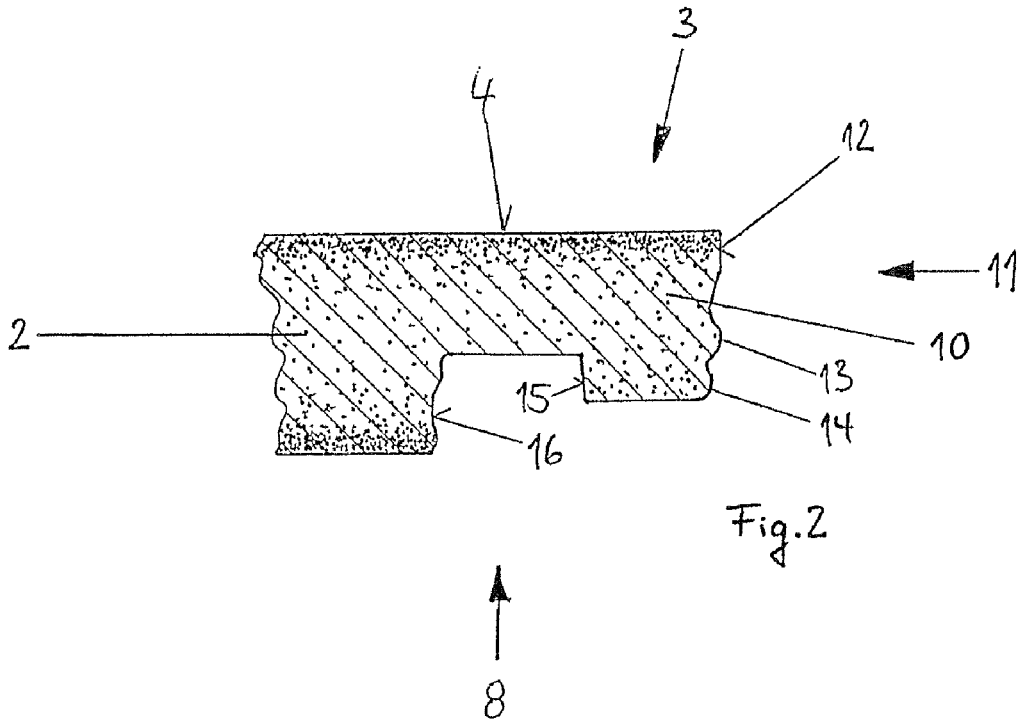
Figure 3:
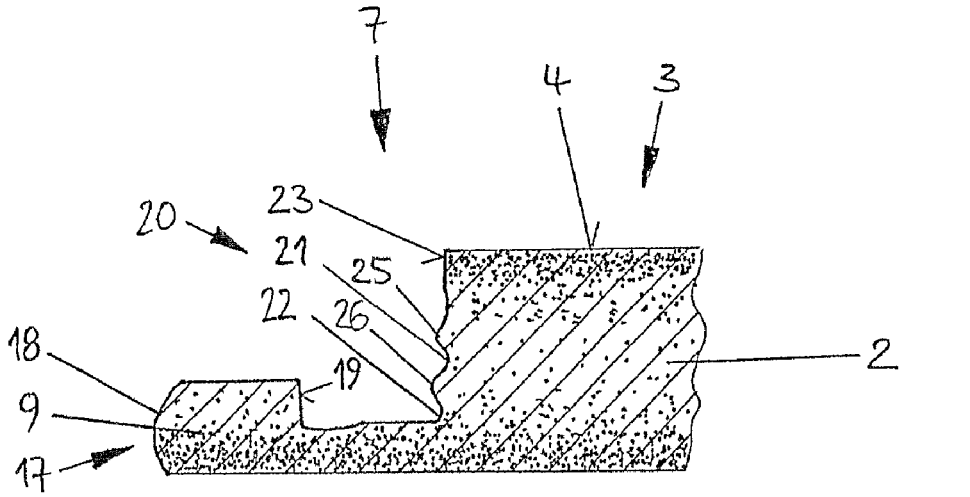

An example of the invention is illustrated in a drawing below, and described in detail on the basis of the individual Figures. The Figures show the following:

FIG. 1 A perspective view of a floor panel,

FIG. 2 A detail representation of a receiving hook,

FIG. 3 A detail representation of a retaining hook, and

Figure 4:
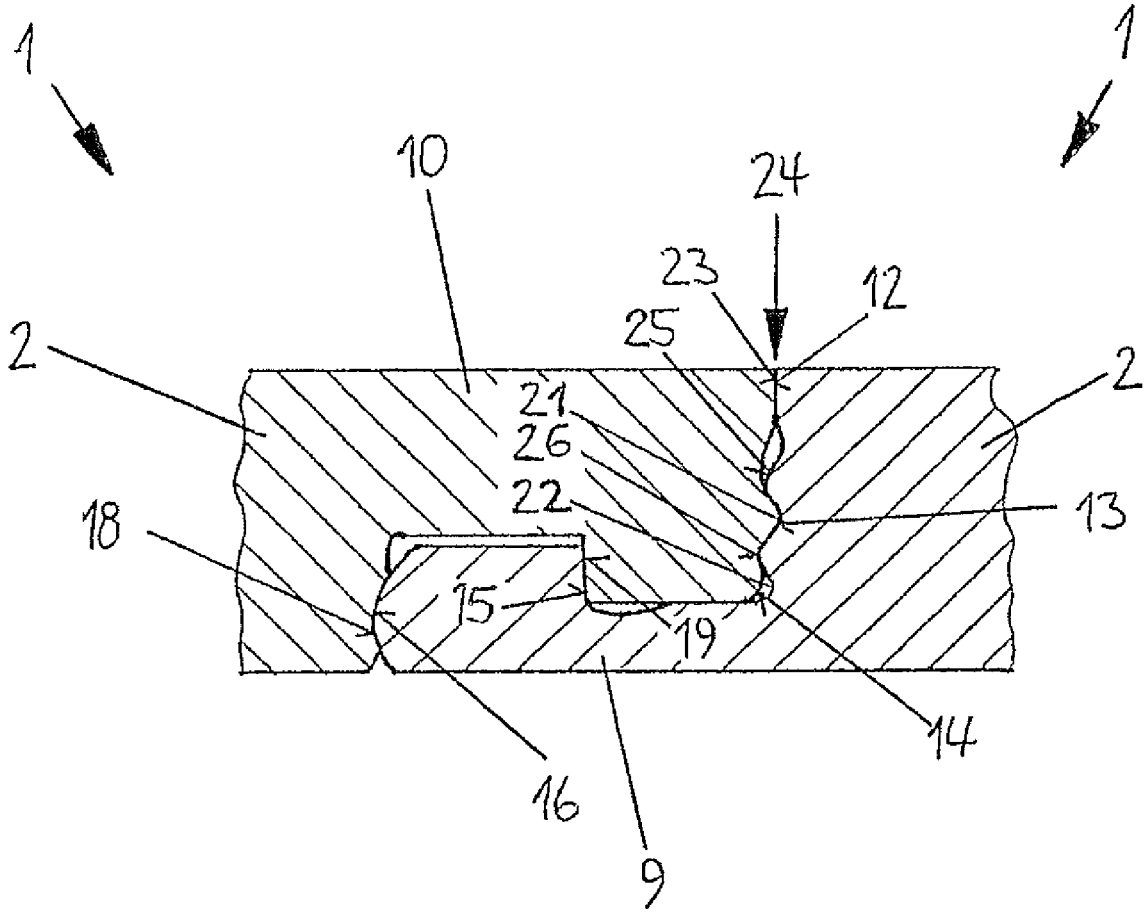

FIG. 4 The receiving hook according to FIG. 2 and the retaining hook according to FIG. 3 in connected state.

According to the drawing, floor panel 1 displays a rectangular, tabular core made of a derived timber material 2. It is provided with a decorative layer 4 on a top side 3 and displays two parallel long side edges 5 and 6, together with two parallel short side edges 7 and 8. The side edges are intended for connecting several similar floor panels 1. To this end, long side edges 5 and 6 display form-fitting interlocking profiles, namely an undercut tongue 5*a* on side edge 5 and an undercut groove 6*a* on opposite side edge 6.

Several floor panels 1 are laid in rows. The interlocking profiles of long side edges 5 and 6 serve to connect the individual rows of floor panels 1. A long side edge 5 of a new floor panel 1 is first contacted with a complementary interlocking profile of a previous panel row. The new floor panel 1 is initially positioned at an angle. This means that, at the start of the connecting procedure, the new floor panel 1 is held in a plane that is inclined relative to the plane assumed by floor panels 1 in their working position. In the spirit of the invention, the working position of floor panels 1 is also referred to as the working plane of floor panels 1.

By swinging down new floor panel 1 into the working plane, the interlocking profiles of long side edges 5 and 6 are connected in form-fitting fashion. The form fit prevents separation of the two floor panels 1 in the working plane transversely to long side edges 5 and 6. Perpendicularly to the working plane, the form fit moreover prevents vertical offset between interlocked long side edges 5 and 6.

Within a row, floor panels 1 are connected to each other at their short side edges 7 and 8, which are also referred to as face edges 7 and 8.

Hooked profiles are provided on face edges 7 and 8 of the illustrated floor panel 1. In reference to a horizontal working position of floor panel 1, complementary hooked profiles are connected to each other by a vertical joining movement.

A hooked profile of a face edge 7 of floor panel 1 can be seen in the foreground in FIG. 1. The hooked profile projects from face edge 7 and is located close to the lower side of floor panel 1. It is open towards top side 3 of floor panel 1 and is referred to as receiving hook 9 in the spirit of the invention. Opposite face edge 8 displays a complementary hooked profile, the cross-sectional shape of which is shown in enlarged form in FIG. 2. In the spirit of the invention, this hooked profile is referred to as retaining hook 10. FIG. 3 shows the cross-sectional shape of receiving hook 9 from FIG. 1 in enlarged form.

Both in FIG. 2 and in FIG. 3, the density of the derived timber material of the core made of a derived timber material 2 is represented symbolically by dotting of the cross-section. The core made of a derived timber material 2 displays a high density near to top side 3 and near to the lower side. From top side 3, the density decreases with increasing material depth, reaching a minimum roughly in a central plane or central layer of the core made of a derived timber material 2.

According to FIG. 2, retaining hook 10 displays a distal side surface 11, which is provided with a contact surface 12 facing towards the top side and with two projecting interlocking elements 13 and 14. The distance from top side 3 to first interlocking element 13 is more than one-third of the total thickness of floor panel 1. Second interlocking element 14 is located behind first interlocking element 13 at a greater distance from top side 3 of floor panel 1. Both interlocking elements, 13 and 14, are located in material areas of the derived timber material that display a relatively low density compared to the density close to top side 3 of floor panel 1.

Apart from distal side surface 11, retaining hook 10 displays an undercut surface 15 that interacts with receiving hook 9 in connected state. A recess 16, facing towards the lower side, is provided on retaining hook 10 on proximal side surface 11'.

Receiving hook 9, illustrated in FIG. 3, displays a single interlocking element 18 on a distal side surface 17. Distal side surface 17 of receiving hook 9 has a smaller height than distal side surface 11 of retaining hook 10. Receiving hook 9 is provided with an undercut surface 19 that interacts with undercut surface 15 of retaining hook 10 in interlocked state of two floor panels 1. Undercut surface 19 of receiving hook 9 is located a distance behind distal side surface 17.

Undercut surfaces 15 and 19 of interlocked floor panels 1 prevent separation of floor panels 1 in their working plane and perpendicularly to face edges 7 and 8.

Provided at roughly the same distance behind undercut surface 19 of receiving hook 9 is a receiving surface 20 with receiving pockets 21 and 22 for the two interlocking elements 13 and 14 of retaining hook 10. Towards top side 3 of floor panel 1, receiving surface 20 transitions into a contact surface 23. In connected state of floor panels 1, contact surfaces 12 and 23 of the retaining hook and the receiving hook form a joint 24, visible from top side 3.

Receiving surface 20 displays two projecting interlocking humps 25 and 26. Each receiving pocket 21 and 22 is preceded by one of interlocking humps 25 and 26. An interlocking hump 25 or 26 is located n front of each receiving pocket 21 and 22 in the direction in which retaining hook 10 is moved for the purpose of interlocking. Interlocking elements 13 and 14 of retaining hook 10 must be moved, by elastic deformation of the derived timber material, behind interlocking humps 25 and 26, together with which they form an undercut in this way. The hooked profiles undercut in this way secure the floor panels to prevent separation in a direction perpendicular to the working plane of floor panels 1.

First interlocking hump 25 projects farther from side edge 7 than contact surface 23 of receiving hook 9. Because first interlocking hump 25 projects farther from side edge 7 of receiving hook 9 than its contact surface 23, interlocking element 13 of retaining hook 10 is designed in such a way that it can be moved past contact surface 23 of receiving hook 9 without obstruction, until it strikes interlocking hump 25 and overcomes it by mutual elastic deformation. Second interlocking element 14 of retaining hook 10 projects a shorter distance from distal side surface 11. As a result, it can be moved past first interlocking hump 25 of receiving hook 9. As soon as second interlocking element 14 of retaining hook 10 reaches second interlocking hump 26, contact is made because second interlocking hump 26 projects farther than first interlocking hump 25.

The derived timber material has to be elastically deformed in order to move second interlocking element 14 into receiving pocket 22 behind second interlocking hump 26.

In the present design, interlocking of the two interlocking elements 13 and 14, past interlocking humps 25 and 26, takes place almost simultaneously.

The elastic deformation and material compression take place at a great distance from top side 3 of floor panels 1. The density of the core made of a derived timber material 2 is low in this area. This avoids cracking close to decorative layer 4 of floor panels 1.

LIST OF REFERENCE NUMBERS

1 Floor panel
2 Core made of a derived timber material
3 Top side
4 Decorative layer
5 Long side edge
5*a* Tongue
6 Long side edge
6*a* Groove
7 Short side edge
8 Short side edge
9 Receiving hook
10 Retaining hook
11 Distal side surface (retaining hook)
12 Contact surface (retaining hook)
13 Interlocking element
14 Interlocking element
15 Undercut surface (retaining hook)
16 Recess
17 Distal side surface (receiving hook)
18 Interlocking element
19 Undercut surface (receiving hook)
20 Receiving surface
21 Receiving pocket
22 Receiving pocket
23 Contact surface (receiving hook)
24 Joint
25 Interlocking hump
26 Interlocking hump

The invention claimed is:

1. A rectangular floor panel, comprising a core in the floor panel, made of a derived timber material, a decorative layer on a top side of the floor panel, pairs of opposite side edges on the floor panel, where at least one pair of side edges displays complementary, form-fitting hooked profiles, one of the complementary, form-fitting hooked profiles being a receiving hook extending vertically upward from a bottom side of the floor panel and, the other of the complementary, form-fitting hooked profiles, on the opposite side edge, being a retaining hook extending vertically downward from the top side of the floor panel, the retaining hook having a distal side surface with at least one elastically deformable horizontally projecting interlocking element, the retaining hook having a horizontal recess on a proximal side surface, the receiving hook having a receiving surface with at least one receiving pocket for receiving the projecting interlocking element of the retaining hook and at least one elastically deformable horizontally projecting interlocking hump, the interlocking hump being positioned above the pocket, on the receiving surface, the receiving hook having a distal side surface with a horizontally projecting interlocking element on the distal side surface, the retaining hook is lockable with the receiving hook by a locking vertical movement perpendicular to the plane of the floor panel, wherein the interlocking element of the retaining hook and the interlocking hump mutually elastically deform during the locking vertical movement, the projecting interlocking element of the receiving hook is received in and contacts the recess of the retaining hook and the interlocking element of the retaining hook and the top side of the floor panel are separated by a distance that, referred to the total thickness of the floor panel, corresponds to at least one-third of the total thickness of the floor panel, wherein the distal side surface of the retaining hook comprises first and second interlocking elements and a contact surface proximate the top side of the floor panel, the first and second interlocking elements being located below the contact surface such that the contact surface is interposed between the top side of the floor panel and the first and second interlocking elements, wherein the first interlocking element is located closer to the top side of the floor panel and projects horizontally farther from the distal side surface of the retaining hook as compared to the second interlocking element.

2. The rectangular floor panel according to claim 1, wherein the receiving surface of receiving hook has a contact surface and the contact surface of each of the retaining and receiving hooks rest against each other in a connected state of two floor panels.

3. The rectangular floor panel according to claim 2, wherein the second interlocking element of the retaining hook projects horizontally less than the first interlocking element.

4. The rectangular floor panel according to claim 1, wherein two elastically deformable, horizontally projecting interlocking humps and two receiving pockets are on the receiving surface of the receiving hook, a first interlocking hump above a first receiving pocket and a second interlocking hump above a second receiving pocket, the two interlocking humps and the first and second interlocking elements mutually elastically deform during the locking vertical movement.

5. The rectangular floor panel according to claim 4, wherein the first interlocking hump is a shorter distance from the top side of the floor panel and projects a shorter distance from the receiving surface than the second interlocking hump.

* * * * *

UNITED STATES PATENT AND TRADEMARK OFFICE

CERTIFICATE OF CORRECTION

PATENT NO. : 8,375,672 B2
APPLICATION NO. : 11/917630
DATED : February 19, 2013
INVENTOR(S) : Hans-Juergen Hannig It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 221 days.

Signed and Sealed this
First Day of September, 2015

Michelle K. Lee

Michelle K. Lee
*Director of the United States Patent and Trademark Office*